US005196759A

United States Patent [19]

Parham et al.

[11] Patent Number: 5,196,759

[45] Date of Patent: Mar. 23, 1993

[54] HIGH TEMPERATURE LAMPS HAVING UV ABSORBING QUARTZ ENVELOPE

[75] Inventors: Thomas G. Parham, Gates Mills, Ohio; Robert L. Bateman, Jr., Kitty Hawk, N.C.; Gary R. Allen; Paul G. Mathews, both of Chesterland, Ohio

[73] Assignee: General Electric Company, Schenectady, N.Y.

[21] Appl. No.: 843,660

[22] Filed: Feb. 28, 1992

[51] Int. Cl.[5] ..... H01K 1/32; H01J 61/30

[52] U.S. Cl. ..... 313/112; 313/579; 313/580; 313/636

[58] Field of Search ..... 313/112, 636, 579, 580

[56] References Cited

U.S. PATENT DOCUMENTS 2,774,903 12/1956 Burns ..... 313/636 X
3,253,174 5/1966 Elmer et al. ..... 313/636 X
3,531,677 9/1970 Loughridge ..... 313/636 X
4,935,668 6/1990 Hansler et al. ..... 313/112 X

FOREIGN PATENT DOCUMENTS 113550 7/1982 Japan ..... 313/636

*Primary Examiner*—Palmer C. DeMeo
*Attorney, Agent, or Firm*—Edward M. Corcoran; Stanley C. Corwin

[57] ABSTRACT

Fused quartz containing both titanium dioxide and cerium oxide as UV absorbing dopants has been found to be particularly effective for lamp envelopes for high temperature lamps such as halogen-incandescent lamps and metal halide arc discharge lamps which emit both UV and visible light radiation. The codoped quartz transmits visible radiation and absorbs a substantial portion of the emitted UV radiation. The UV absorption is far superior at temperatures above 500° C. and the codoped quartz does not react with the fill within.

15 Claims, 5 Drawing Sheets

HIGH TEMPERATURE LAMPS HAVING UV ABSORBING QUARTZ ENVELOPE

BACKGROUND OF THE INVENTION

1. Field of the Invention

This invention relates to lamps which operate at high temperatures and have a light source which emits both visible and UV light radiation which is surrounded by a UV absorbing quartz envelope codoped with both ceria and titania. More particularly, this invention relates to lamps comprising a UV absorbing fused quartz envelope codoped with ceria and titania which is at a temperature of at least 500° C. during lamp operation and which encloses a source of light which emits both UV and visible light radiation.

2. Background of the Disclosure

Fused silica or fused quartz as it is also known is used as a light-transmissive, vitreous envelope material for high intensity lamps, such as gas discharge lamps and halogen-incandescent lamps, because of its excellent transmission of visible light and its ability to withstand high operating temperatures of up to about 1100° C. Almost all arc discharge lamps and many high intensity filament lamps, such as tungsten-halogen lamps, emit ultraviolet (UV) radiation which is harmful to human eyes and skin and which also causes fading of fabrics, plastics and paint and yellowing and/or hazing of many types of plastics employed in lamp fixtures and lenses. Fused quartz is an excellent transmitter of UV radiation and therefore provides no shielding against the emission of such radiation by an arc or filament light source enclosed within a lamp envelope made of fused quartz. As a result, lamps have been developed comprising a light source which emits both UV and visible light radiation enclosed within a vitreous envelope of fused quartz or glass containing UV-absorbing materials, or dopants as they are called, so that the lamp envelope will, of itself, absorb the UV radiation emitted by the light source. Illustrative, but non-limiting examples of such efforts in the past are disclosed in U.S. Pat. Nos. 2,895,839; 3,148,300; 3,848,152; 4,307,315 and 4,361,779. However, there is still a need for a vitreous material useful for lamp envelopes which are heated to a temperature above 500° C. during lamp operation and which will absorb UV radiation at wavelengths from 200–380 nm along with minimal absorption of visible light radiation from 380–750 nm. Such a material should also be a homogeneous, colorless, glassy material and dopants present should be of a type and in an amount which minimizes or avoids chemical reactions between the doped lamp envelope and metal halides and other chemicals present in both an arc discharge lamp and a halogen-incandescent lamp. The ability of the material to be used at temperatures in excess of 500° C. should not be impaired by the dopants or the material will not be useful for high temperature lamps.

SUMMARY OF THE INVENTION

It has now been found that a lamp envelope made of fused quartz which contains both titanium dioxide and cerium oxide as UV absorbing dopants is useful at high temperatures, transmits visible light radiation and absorbs UV radiation, with the UV absorption being greater at temperatures above 500° C. than at temperatures below 500° C. Thus the invention relates to a high temperature lamp comprising a UV emitting light source enclosed within or surrounded by a UV-absorbing and visible light transmissive fused quartz envelope containing both titanium dioxide and cerium oxide as UV absorbing dopants. The source of UV radiation may be an arc discharge, either electroded or electrodeless, or it may be an incandescent filament. By fused quartz is meant quartz having a high $SiO_2$ content of at least 96 wt. % and preferably at least 99 wt. %.

DETAILED DESCRIPTION

Fused quartz codoped with both titanium dioxide and cerium oxide UV absorbants was prepared by mixing the appropriate amounts of high purity natural quartz sand with reagent grade titanium dioxide ($TiO_2$) and cerium dioxide ($CeO_2$) in powder form slurried in acetone. Typical impurity levels in the quartz sand used to make both undoped and titanium dioxide and cerium oxide codoped fused quartz are set forth in the table below.

| Impurity Element | Concentration (ppm by Weight) |
|---|---|
| Al | 14.6 |
| Ca | 0.4 |
| Cu | <0.05 |
| Fe | 0.2 |
| K | 0.5 |
| Li | 0.5 |
| Mg | <0.1 |
| Mn | <0.03 |
| Na | 0.6 |
| Ti | 1.1 |
| Zr | 0.5 |

Undoped fused quartz of this purity in the form of tubing useful for making lamp envelopes is available from GE Lighting in Cleveland, Ohio, designated as GE214 Fused Quartz.

In making the codoped quartz, a slurry of quartz sand, $TiO_2$ and $CeO_2$ was ground until it appeared homogeneous and the resulting dry powder was fused for two hours at 2000° C. under a hydrogen atmosphere to form the codoped fused quartz. Lamps were made both from the undoped and codoped fused quartz. Batches of the codoped fused quartz containing the titanium dioxide and cerium oxide were made using the above procedure and containing the following amounts of titanium and cerium expressed in weight parts per million (wppm) of the total quartz composition. Although the measurements reflect the amount of elemental titanium and cerium present, in the fused quartz they are in the form of titanium dioxide and cerium oxide, respectively.

| Batch | Amount of Titanium | Amount of Cerium |
|---|---|---|
| A | 500 | 2000 |
| B | 500 | 3000 |
| C | 500 | 4000 |

Figure 2A:
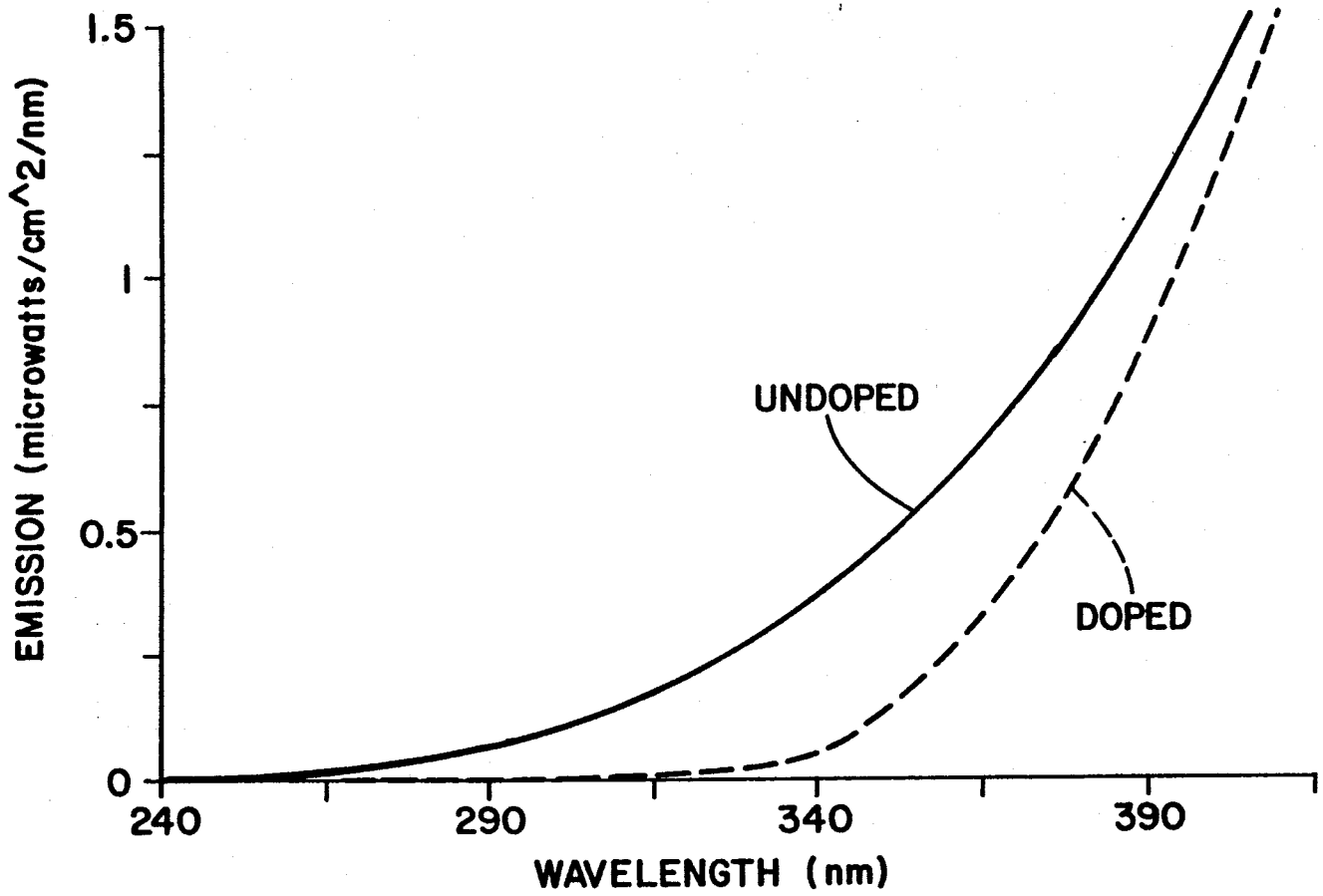
FIG. 2(*a*) illustrates the UV emission spectra for a lamp and reflector assembly illustrated schematically in FIG. 2(*b*) having both an undoped fused quartz lamp envelope and one codoped with both titanium dioxide and cerium oxide.
Figure 2B:
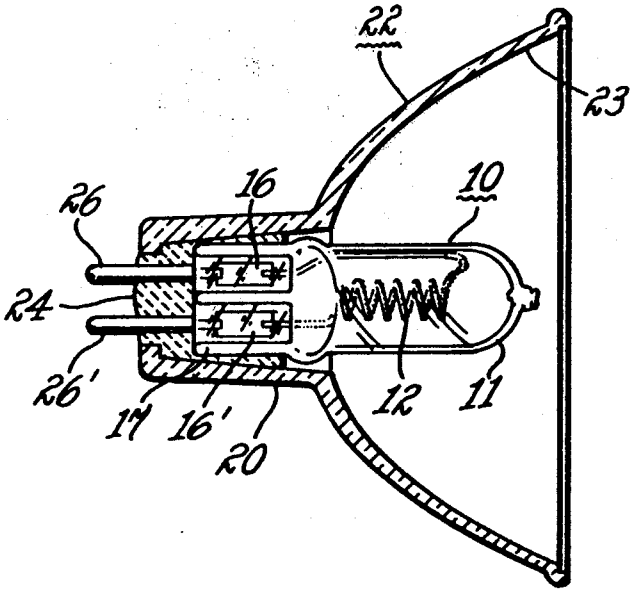
Figure 3A:
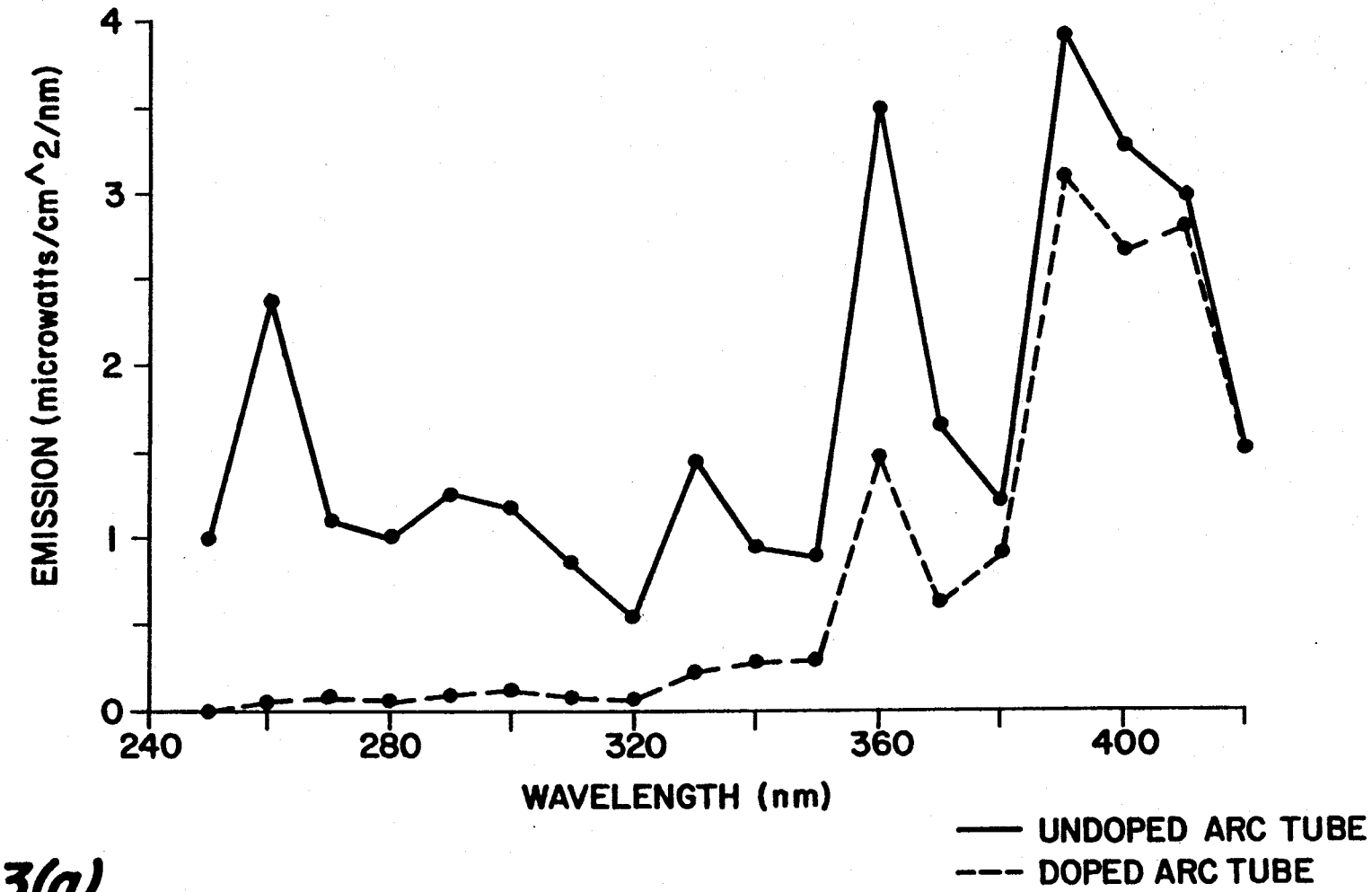
FIG. 3(*a*) illustrates the UV transmission spectra for a metal halide arc lamp having both an undoped fused quartz arc chamber and one codoped with titanium dioxide and cerium oxide and FIG. 3(*b*). schematically illustrates the type of arc lamp employed.
Figure 3B:
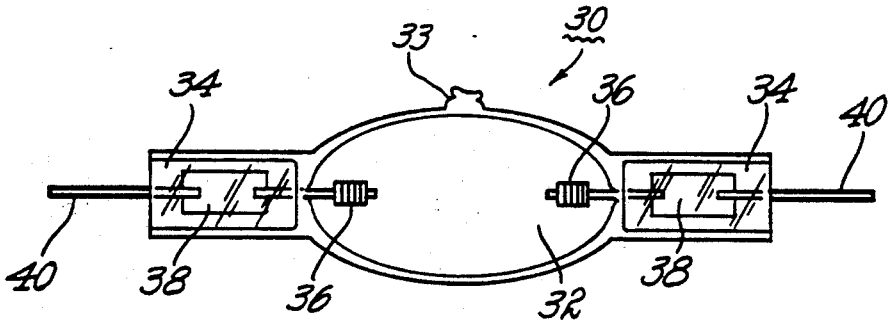

Batch A was used to make lamp envelopes for metal halide arc discharge lamps of a type illustrated in FIG. 3(*b*) wherein the arc chamber wall portion reached a temperature of about 925° C. during operation of the lamp. Batch B is used to make the glass envelope of tungsten-halogen incandescent lamps, including the type illustrated in FIG. 2(*b*) wherein the temperature of the envelope can range from about 550° C. to 900° C. during operation of the lamp (depending on the wattage) and Batch C was made for both the shroud portion of the shrouded metal halide arc discharge lamp of the type illustrated in FIG. 4 and for low wattage tungsten-halogen lamps wherein the temperature of the quartz can vary from about 550°-650° C.

The total amount of titanium dioxide and cerium oxide dopants in the fused quartz is dictated by two factors. One is reaction of the atmosphere or fill enclosed within the lamp envelope with the titanium and cerium present in the fused quartz and the other is the temperature reached by the fused quartz during operation of the lamp. In the former case reaction with the lamp envelope can cause color shift, lumen loss, short lamp life, and devitrification, whereas in the latter case, increasing the amounts of the dopants decreases the useful working temperature of the fused quartz due to devitrification, distortion or sagging and melting. The optimum amount of the titanium dioxide and cerium oxide dopants employed to make the codoped fused quartz must be determined by the practitioner for each specific case. By way of illustrative, but nonlimiting example, the total amount of both titanium and cerium in the fused quartz should not exceed (i) 0.3 wt. % if the codoped quartz will reach temperatures of about 1100° C. during lamp operation and (ii) 0.5 wt. % at about 800° C. Finally, it is important that the valence of the titanium in the quartz be plus four and not plus two. If the valence of the titanium is less than plus four (i.e., +2 as in TiO), the quartz becomes black in color instead of clear and light transparent. The upper limit on the amount of $TiO_2$ is somewhat controlled by the fused quartz manufacturing process. If the codoped fused quartz is prepared in a hydrogen reducing atmosphere, exceeding 500 wppm of titanium (i.e., 1000 wppm) has resulted in blackened quartz. The cerium oxide used can be either $Ce_2O_3$, $CeO_2$ or mixture thereof. Finally, the titanium dioxide and cerium oxide dopants may be replaced all or in part by one or more suitable precursors including an organometallic compound such as alkoxide, a sol or a gel.

Figure 1:
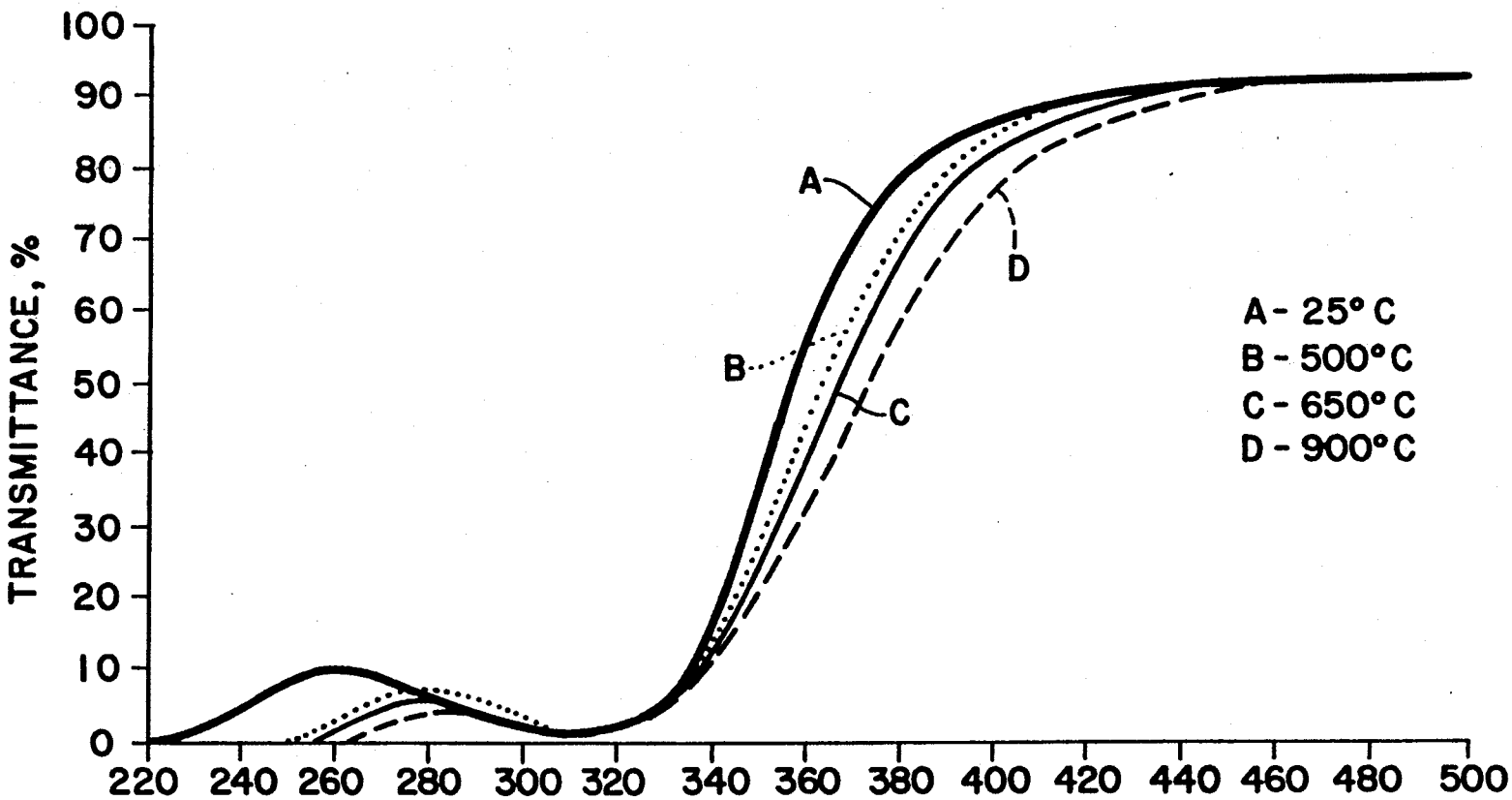
FIG. 1 is a graph illustrating the UV transmission spectra of titanium dioxide and cerium oxide codoped fused quartz as a function of temperature.

FIG. 1 illustrates the ultraviolet transmission spectra as a function of quartz temperature for fused quartz codoped with 500 wppm and 4000 wppm titanium and cerium, respectively, from 220-500 nm for 0.7 mm wall thickness fused quartz tubing measured at a distance of 50 cm using a spectrophotometer. The titanium and cerium were present in the quartz as titanium dioxide and cerium oxide. The spectra were recorded from 220 to 500 nm with a photomultiplier detector tube sensitive to UV. One can readily see that increasing the temperature of the codoped fused quartz substantially increases the UV absorption between 230-280 nm with a concomitant decrease in UV transmittance.

FIG. 2 illustrates both the measured and calculated UV emission spectra reflected forward from a lamp and reflector assembly as illustrated in FIG. 2(*b*). Thus, turning to FIG. 2(*b*), halogen-incandescent lamp 10 having a filament 12 and a halogen fill (not shown) hermetically sealed within fused quartz envelope 11 is shown cemented by cement 24 into the rearwardly protruding nose portion 20 of glass reflector 22 having a forward light reflecting surface 23. Filament 12 is electrically connected to outer leads 26, 26' by means of molybdenum foil seals 16, 16, in the press seal portion 17 of lamp 10 as is well known to those skilled in the art. The maximum inner diameter of reflector 22 was two inches. The data in FIG. 2 is based on lamp 10 operated at a filament temperature of 2930° K. and lamp envelope 11 made of both undoped GE214 fused quartz lamp tubing and codoped fused quartz tubing containing 500 wppm of titanium and 4000 wppm of cerium in the form of titanium dioxide and cerium oxide, respectively. Turning to FIG. 2(*a*), Curve A is the measured UV radiation projected forward of reflector 22 with an undoped quartz lamp envelope and Curve B is a calculated spectra for fused quartz lamp envelope 11 codoped with 500 and 4000 wppm of titanium and cerium, respectively, based on the measured transmittance for the undoped envelope. The significant difference in UV emission is apparent. Further, the NIOSH Erythema and Conjunctivitus (NIOSH E&C) value for the undoped quartz was only 0.65 hours, whereas the NIOSH E&C value using the codoped quartz was 10 hours. Thus, the same lamp and reflector assembly using the codoped quartz is fifteen times safer than using undoped quartz. The NIOSH E&C value is a calculated number describing the recommended exposure for a worker in the workplace and refers to UV levels on the worker. It is defined by a U.S. Government document NIOSH 73-1109 "Criteria for a Recommended Standard, Occupational Exposure to UV" published by the U.S. Department of Health, Education and Welfare in 1973. The NIOSH E&C values referred to here relate to the UV exposure time calculated by weighting the emitted UV flux for erythema and conjunctivitus, i.e., skin and eye damage. The value should be greater than 8 hours. The measurements relate the spectral power (in microwatts/sq. cm/nm) to the NIOSH E&C weighting factors to calculate the effective NIOSH E&C exposure time.

FIG. 3(*a*) is a graph illustrating UV emission for a 100 watt metal halide arc lamp fabricated from both the undoped GE214 lamp tubing and from fused quartz lamp tubing codoped with titanium dioxide and cerium oxide and containing 500 wppm titanium and 2000 wppm cerium. The lamp was of the type briefly and schematically illustrated in FIG. 3(*b*). Turning to FIG. 3(*b*) there is illustrated arc lamp 30 comprising arc chamber 32 enclosing within a pair of spaced apart electrodes 36, inert gas, mercury and metal halide (not shown). Electrodes 36 are welded at one end to molybdenum foil seals 38 hermetically pinch sealed in pinch seal end portions 34. Outer leads 40 are welded to the other end of respective molybdenum foil seals 38 to provide electricity to electrodes 36. Arc chamber 32 and tubular portions 34 were formed from a single piece of fused quartz tubing as is well known to those skilled in the art. Exhaust tip-off 33 is formed after the arc chamber is evacuated and filled and the exhaust tube (not shown) tipped off. Lamps of this type were made using both undoped fused quartz tubing and fused quartz tubing codoped with titanium dioxide and cerium oxide as stated above. The arc chamber was a 22 mm × 12 mm ellipse having a volume of 1 cc and a 1 mm wall thickness containing a pair of electrodes, argon, mercury and a mixture of sodium and scandium iodides. The arc tube operated at 100 V and 1.2 amps. FIG. 3(*a*) illustrates the UV emission spectrum for both lamps and one immediately appreciates the significant difference in UV emission between lamps made from undoped fused quartz and those made from fused quartz codoped with both the titanium dioxide and cerium oxide. The wall of the arc chamber was at about 900° C. during operation of the lamps. The UV spectra were measured as previously described. Applying the NIOSH E&C times revealed that the lamps made from the codoped fused quartz had an allowable exposure time twenty times greater than lamps made from the undoped fused quartz.

Figure 4:
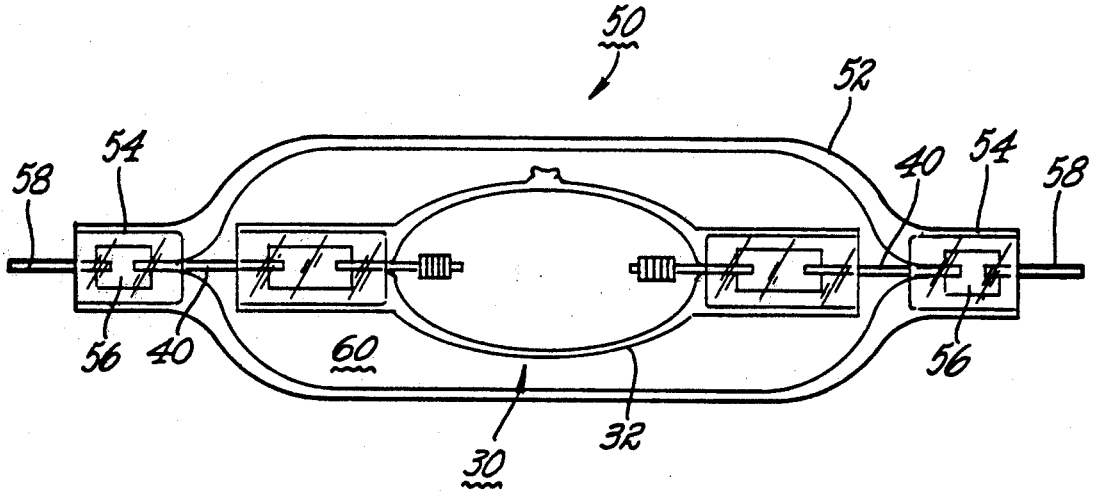
FIG. 4 schematically illustrates a type of shrouded arc lamp employed in accordance with the invention.

FIG. 4 illustrates another embodiment of the invention wherein an arc discharge lamp is enclosed within a codoped fused quartz shroud. Employing a codoped shroud permits the use of a greater amount of titanium dioxide and cerium oxide in the fused quartz because it does not get as hot as the fused quartz envelope of the arc lamp. Thus, turning to FIG. 4, metal halide arc discharge lamp 30 is illustrated as being hermetically enclosed within shroud 50 comprising envelope 52 made of fused silica codoped with titanium dioxide and cerium oxide. Envelope 52 is hermetically sealed at both ends 54 by pinch seals over molybdenum foil seals 56 one end of each of which is attached to lamp leads 40 and the other end to outer leads 58. Space 60 may be a vacuum or contain a suitable gas, such as one or more noble gases, nitrogen, etc. Because shroud envelope 52 does not get as hot (i.e., 550°-650° C.) as lamp envelope 32 (i.e., 800°-1100° C.) during operation of the lamp, a greater amount of codopants can be used than can be in the lamp envelope as described above. This results in absorption of greater amounts of UV radiation emitted by the lamp with concomitant less UV emitted into the surrounding ambient. Lamps of the general construction of the type illustrated in FIG. 4, but without the codoped shroud, are presently used in commerce and are disclosed, for example, in U.S. Pat. No. 4,935,668. In yet another embodiment, both the lamp envelope and the shroud may be codoped fused quartz according to the invention which will result in still less UV radiation emitted into the surrounding ambient.

The foregoing is intended to be illustrative, but nonlimiting with respect to the scope of the invention. Other embodiments will be appreciated by those skilled in the art such as electrodeless arc discharge lamps wherein the arc chamber is fabricated from the codoped fused quartz according to the invention. Further, according to the invention, lamps may also have a thin film optical interference filter disposed on the wall of the arc or filament chamber for changing the color of the emitted light or reflecting infrared radiation back to the filament or arc and transmitting visible light radiation.

What is claimed is:

1. A lamp comprising a light source which emits both UV and visible light radiation surrounded by a UV-absorbing and visible light transmissive fused quartz envelope codoped with both titanium dioxide and cerium oxide to absorb at least a portion of said UV radiation, with said envelope being at a temperature above 500° C. during operation of said lamp.

2. The lamp of claim 1 wherein said source of UV and visible light radiation comprises a filament.

3. The lamp of claim 2 comprising a halogen-incandescent lamp.

4. The lamp of claim 1 wherein said source of UV and visible light radiation comprises an arc discharge.

5. The lamp of claim 4 including at least one metal halide in said arc discharge.

6. An incandescent lamp having a light source comprising a filament light source hermetically sealed within a fused quartz envelope, wherein said light source emits both UV and visible light radiation and wherein said fused quartz envelope is codoped with both titanium dioxide and cerium oxide to absorb at least a portion of said UV radiation emitted by said light source, with said envelope being at a temperature above 500° C. during operation of said lamp.

7. The lamp of claim 6 wherein at least one halogen is enclosed within said envelope.

8. The lamp of claim 7 wherein said filament is a tungsten filament.

9. The lamp of claim 8 wherein said cerium oxide is selected from the group consisting essentially of $CeO_2$, $Ce_2O_3$ and mixture thereof.

10. The lamp of claim 9 wherein the amount of both titanium and cerium present in said titanium dioxide and said cerium oxide does not exceed 0.5 wt. % of said fused quartz composition.

11. The lamp of claim 10 wherein said titanium is present in a valence state of plus four.

12. An arc discharge lamp comprising an arc discharge which emits both UV and visible light radiation enclosed within a visible, light-transmissive envelope made of fused quartz codoped with both titanium dioxide and cerium oxide to absorb at least a portion of said UV radiation emitted by said arc discharge and wherein said envelope is at a temperature of greater than 500° C. during operation of said lamp.

13. The lamp of claim 12 further including at least one metal halide in said arc discharge.

14. The lamp of claim 13 wherein said arc discharge is an electrodeless arc discharge.

15. An arc discharge lamp comprising an arc discharge which emits both UV and visible light radiation enclosed within a fused quartz arc chamber and wherein a fused quartz shroud codoped with both titanium dioxide and cerium oxide surrounds said arc chamber to absorb at least a portion of said UV radiation emitted by said arc discharge, said shroud being at a temperature above 500° C. during operation of said lamp.

* * * * *

US005196759B1

REEXAMINATION CERTIFICATE (3004th)

United States Patent [19] [11] B1 5,196,759

Parham et al. [45] Certificate Issued Sep. 24, 1996

[54] HIGH TEMPERATURE LAMPS HAVING UV ABSORBING QUARTZ ENVELOPE

[75] Inventors: Thomas G. Parham, Gates Mills, Ohio; Robert L. Bateman, Jr., Kitty Hawk, N.C.; Gary R. Allen; Paul G. Mathews, both of Chesterland, Ohio

[73] Assignee: General Electric Company, Cleveland, Ohio

Reexamination Request:
No. 90/003,445, May 26, 1994

Reexamination Certificate for:

| | |
|---|---|
| Patent No.: | **5,196,759** |
| Issued: | **Mar. 23, 1993** |
| Appl. No.: | **843,660** |
| Filed: | **Feb. 28, 1992** |

[51] Int. Cl.[6] ..... H01K 1/32; H01J 61/30

[52] U.S. Cl. ..... 313/112; 313/579; 313/580; 313/636

[58] Field of Search ..... 313/113, 112, 313/636, 579; 362/255, 256, 293

[56] References Cited

U.S. PATENT DOCUMENTS

| | | | |
|---|---|---|---|
| 2,924,636 | 2/1960 | Broderick et al. . | |
| 3,148,300 | 9/1964 | Graff . | |
| 3,531,677 | 9/1970 | Loughridge . | |
| 3,848,152 | 11/1974 | Schultz . | |
| 4,361,779 | 11/1982 | van der Steen et al. . | |
| 4,652,790 | 3/1987 | Wood . | |
| 5,220,235 | 6/1993 | Wakimizu et al. | 362/255 |
| 5,236,876 | 8/1993 | Van Hal et al. . | |

FOREIGN PATENT DOCUMENTS

| | | |
|---|---|---|
| 2599890 | 6/1986 | France . |
| 51-86515 | 7/1976 | Japan . |
| 52-89280 | 7/1977 | Japan . |
| 53-20566 | 2/1978 | Japan . |
| 60-138845 | 7/1985 | Japan . |
| 62-131463 | 6/1987 | Japan . |
| 91490 | 7/1959 | Netherlands . |

OTHER PUBLICATIONS

SvetotEkhnike, 10, 1986, pp. 25–27; Quartz Glass With Special Properties; Ye. V. Klimashina et al. (translation).
Ilmasil brochure; Rohre füe die Lichtquelle; no date available (translation).
Stabisil brochure; applications of pure fused quartz; draft leaflet S1–13; Oct. 12, 1976.
Heraeus Amerisil brochure; M–382 Cerium Doped Fused Quartz Envelopes; Oct. 1989.

*Primary Examiner*—Nimeshkumar D. Patel

[57] ABSTRACT

Fused quartz containing both titanium dioxide and cerium oxide as UV absorbing dopants has been found to be particularly effective for lamp envelopes for high temperature lamps such as halogen-incandescent lamps and metal halide arc discharge lamps which emit both UV and visible light radiation. The codoped quartz transmits visible radiation and absorbs a substantial portion of the emitted UV radiation. The UV absorption is far superior at temperatures above 500° C. and the codoped quartz does not react with the fill within.

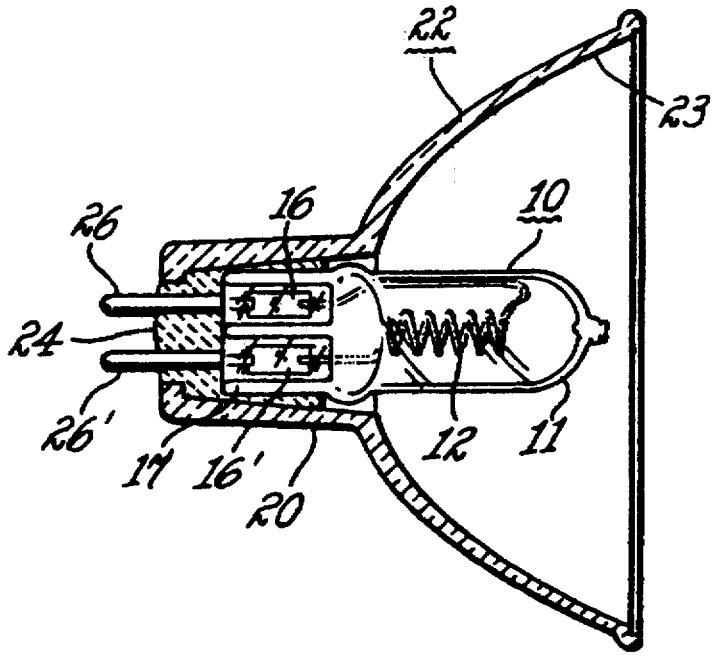

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer part of the patent; matter printed in italics indicates additions made to the patent.

AS A RESULT OF REEXAMINATION, IT HAS BEEN DETERMINED THAT:

Claims 1, 6, 12, and 15 are determined to be patentable as amended.

Claims 2–5, 7–11, 13 and 14, dependent on an amended claim, are determined to be patentable.

New claims 16–36 are added and determined to be patentable.

1. A lamp comprising a light source which emits both UV and visible light radiation surrounded by a UV-absorbing and visible light transmissive fused quartz envelope codoped with both titanium dioxide and cerium oxide to absorb at least [a portion] *80%* of said UV radiation *between 220 and 340 nm,* with said envelope being at a temperature above 500° C. during operation of said lamp.

6. An incandescent lamp having a light source comprising a filament light source hermetically sealed within a fused quartz envelope, wherein said light source emits both UV and visible light radiation and wherein said fused quartz envelope is codoped with both titanium dioxide and cerium oxide to absorb at least [a portion] *80%* of said UV radiation *between 220 and 340 nm* emitted by said light source, with said envelope being at a temperature above 500° C. during operation of said lamp.

12. An arc discharge lamp comprising an arc discharge which emits both UV and visible light radiation enclosed within a visible, light-transmissive envelope made of fused quartz codoped with both titanium dioxide and cerium oxide to absorb at least [a portion] *80%* of said UV radiation *between 220 and 340 nm* emitted by said arc discharge and wherein said envelope is at a temperature of greater than 500° C. during operation of said lamp.

15. An arc discharge lamp comprising an arc discharge which emits both UV and visible light radiation enclosed within a fused quartz arc chamber and wherein a fused quartz shroud codoped with both titanium dioxide and cerium oxide surrounds said arc chamber to absorb at least [a portion] *80%* of said UV radiation *between 220 and 340 nm* emitted by said arc discharge, said shroud being at a temperature above 500° C. during operation of said lamp.

*16. The lamp of claim 1 wherein said envelope is co-doped with a composition consisting essentially of titanium dioxide and cerium oxide.*

*17. The lamp of claim 6 wherein said envelope is co-doped with a composition consisting essentially of titanium dioxide and cerium oxide.*

*18. The lamp of claim 10 wherein the amount of both titanium and cerium does not exceed 0.3% wt. %.*

*19. The arc discharge lamp of claim 12 wherein said envelope is comprised of fused quartz codoped with at least a combined 2,500 parts per million of titanium dioxide and cerium oxide.*

*20. The arc discharge lamp of claim 12 wherein said envelope is comprised of fused quartz codoped with titanium dioxide and at least 2000 ppm cerium oxide.*

*21. The lamp of claim 12 wherein said envelope is enclosed within a shroud.*

*22. The lamp of claim 12 wherein said envelope is co-doped with a composition consisting essentially of titanium dioxide and cerium oxide.*

*23. The lamp of claim 15 wherein said shroud is co-doped with a composition consisting essentially of titanium dioxide and cerium oxide.*

*24. A lamp having a light source comprised of a filament hermetically sealed with at least one halogen in a fused quartz envelope, wherein said light source emits both UV and visible light radiation and wherein said fused quartz envelope is codoped with at least a combined 2,500 parts per million of titanium dioxide and cerium oxide to absorb at least 80% of said UV radiation between the wavelengths from 220 to 340 nm, with said envelope being at a temperature above 500° C. during operation of said lamp.*

*25. The lamp of claim 24 wherein said envelope is codoped with a maximum of about 500 ppm titanium dioxide.*

*26. The lamp of claim 25 wherein said fused quartz envelope is housed within a shroud.*

*27. The lamp of claim 24 wherein said envelope is enclosed within a reflector housing.*

*28. The lamp of claim 24 wherein said envelope is co-doped with a composition consisting essentially of titanium dioxide and cerium oxide.*

*29. A lamp comprising a light source which emits both UV and visible light radiation surrounded by a UV absorbing visible light transmissive fused quartz envelope codoped with titanium dioxide and at least about 2000 parts per million cerium in the form of cerium oxide to absorb at least 80% of said UV radiation in the wavelength from about 220 to 340 nm, with said envelope being at a temperature above 500° C. during operation of said lamp.*

*30. The lamp of claim 29 wherein said envelope is co-doped with a composition consisting essentially of titanium dioxide and cerium oxide.*

*31. A lamp comprising a light source which emits both UV and visible light radiation surrounded by a UV absorbing visible light transmissive fused quartz envelope formed by doping said quartz with at least a combined 2,500 parts per million titanium and cerium in the form of oxides to absorb at least 80% of said UV radiation in the wavelengths between about 220 and about 340 nm, with said envelope being at a temperature above 500° C. during operation of said lamp.*

*32. The lamp of claim 31 wherein said envelope is co-doped with a composition consisting essentially of titanium dioxide and cerium oxide.*

*33. A lamp comprising a light source which emits both UV and visible light radiation surrounded by a UV absorbing visible light transmissive envelope comprised of hydrogen reducing atmosphere prepared fused quartz codoped with a maximum of about 500 ppm titanium in the form of titanium dioxide and at least about 2000 parts per million cerium in the form of cerium oxide to absorb at least 80% of said UV radiation in the wavelengths between about 220 and 340 nm, with said envelope being at a temperature above 500° C. during operation of said lamp.*

*34. The lamp of claim 33 having a UV emission below 0.5 microwatts/sq cm/nm between about 250 and about 350 nm.*

*35. The lamp of claim 33 wherein said envelope is co-doped with a composition consisting essentially of titanium dioxide and cerium oxide.*

*36. A lamp comprising a light source which emits both UV and visible light radiation surrounded by a UV absorbing and visible light transmissive fused quartz envelope containing impurities which may include aluminum, calcium, copper, iron, potassium, lithium, magnesium, manganese, sodium, titanium, and zirconium, co-doped with a composition consisting essentially of at least a combined 2500 parts per million of titanium dioxide and cerium oxide, to absorb at least 80% of said UV radiation between the wavelengths from 220 to 340 nanometers, with said envelope being at a temperature above 500° C. during operation of said lamp.*

* * * * *